US006799610B2

(12) United States Patent
Yuen

(10) Patent No.: US 6,799,610 B2
(45) Date of Patent: Oct. 5, 2004

(54) METHOD AND APPARATUS FOR REFILLING AN INK CARTRIDGE

(76) Inventor: Kenneth Yuen, P.O. Box 296, San Gabriel, CA (US) 91778

( * ) Notice: Subject to any disclaimer, the term of this patent is extended or adjusted under 35 U.S.C. 154(b) by 0 days.

(21) Appl. No.: 10/251,494

(22) Filed: Sep. 20, 2002

(65) Prior Publication Data

US 2004/0055661 A1 Mar. 25, 2004

(51) Int. Cl.[7] ..... B65B 1/04

(52) U.S. Cl. ..... 141/2; 141/18; 141/114; 347/85

(58) Field of Search ..... 141/2, 18, 20.5, 141/329, 330, 114, 67; 347/85, 86, 87

(56) References Cited

U.S. PATENT DOCUMENTS

| | | | | | |
|---|---|---|---|---|---|
| 4,183,031 | A | * | 1/1980 | Kyser et al. | 347/86 |
| 4,842,028 | A | * | 6/1989 | Kaufman et al. | 141/114 |
| 5,199,470 | A | | 4/1993 | Goldman | |
| 5,488,400 | A | | 1/1996 | Crystal et al. | |
| 5,495,877 | A | | 3/1996 | Schwenk et al. | |
| 5,537,134 | A | | 7/1996 | Baldwin et al. | |
| 5,546,996 | A | * | 8/1996 | Broyles et al. | 141/18 |
| 5,581,287 | A | * | 12/1996 | Baezner et al. | 347/85 |
| 5,912,687 | A | | 6/1999 | Cowger et al. | |
| 5,917,526 | A | | 6/1999 | Wilson et al. | |
| 5,933,175 | A | | 8/1999 | Stathem et al. | |
| 6,158,851 | A | * | 12/2000 | Zepeda | 347/85 |
| 6,273,151 | B1 | * | 8/2001 | Kong | 141/18 |
| 6,347,863 | B1 | | 2/2002 | Yuen | |

FOREIGN PATENT DOCUMENTS

| | | |
|---|---|---|
| JP | 09094799 | 4/1997 |
| WO | WO 02/26502 A1 | 4/2002 |

OTHER PUBLICATIONS

Product detail of Canon BJI–201; http://www.print–rite.com; 1 page; printed Aug. 22, 2002.

Product detail of Canon BC–05; http://www.print–rite.com; 1 page; printed Aug. 22, 2002.

Product detail of Bottom Fill Station with instructions; http://www.print–rite.com; 3 pages; printed Aug. 22, 2002.

"Instructions for refilling a HP 26A/29A ink catridge" and "Troubleshooting Guide," *Dataproducts*, 2 pgs. (Date unknown).

"Refilling Instructions for Hewlett–Packard 51625A Print Cartridges (Kit #DJRE500C) [and] for Hewlett–Packard 51649A Print Cartridge (Kit #DJRE600C)," *Repeat–O–Type Manufacturing Corporation, Wayne NJ*, 1 pg. (Jan. 1998).

* cited by examiner

*Primary Examiner*—Steven O. Douglas
(74) *Attorney, Agent, or Firm*—Merchant & Gould P.C.

(57) ABSTRACT

The present invention provides an easy-to-use refill apparatus for refilling a refillable container. The refill apparatus includes a compressible container containing ink and a compression device that holds the compressible container in alignment with the container to be refilled. In use, the compression device compresses the compressible container thereby causing ink to flow from the compressible container to the refillable container. Decompression of the compressible container removes air out of the refillable container to prevent ink from leaking from the refillable container.

32 Claims, 14 Drawing Sheets

METHOD AND APPARATUS FOR REFILLING AN INK CARTRIDGE

FIELD OF THE INVENTION

The present invention generally relates to filling containers with fluid, and more specifically relates to refilling ink cartridges.

BACKGROUND OF THE INVENTION

Ink jet printers are a popular form of printer used with computers and similar applications involving document printing or graphics preparation. Typical ink jet printers have replaceable ink jet cartridges with built-in print heads. While replaceable ink jet cartridges are a convenient manner of supplying ink to such printers, the cartridges are necessarily expensive due to their complexity and the provision of print heads with the cartridges. Cartridges provided by manufacturers are typically not designed to be refilled when the ink supply runs out. It is well known, however, that such cartridges have useful lives significantly longer than that provided by the initial supply of ink. As a result, there have been substantial efforts directed at providing a simple, easy-to-use system for refilling cartridges with ink.

SUMMARY OF THE INVENTION

The present invention provides an easy-to-use refill apparatus for refilling a refillable container. The refill apparatus includes a compressible container containing ink and a compression device that holds the compressible container in alignment with the container to be refilled. In use, the compression device compresses the compressible container thereby causing ink to flow from the compressible container to the refillable container.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION

The present invention provides an easy-to-use refill apparatus for refilling a refillable container such as an ink jet cartridge. The refill apparatus includes a compressible container containing ink and a compression device that holds the compressible container in alignment with the container to be refilled. When in use, the refill apparatus facilitates ink flow from the compressible pouch to the container to be filled with ink. The following detailed description, with reference to FIGS. 1–31, describes an ink refill apparatus, an ink refill kit that includes an ink refill apparatus, and a method of using an ink refill apparatus.

As used herein, the term "ink jet cartridge" and "ink cartridge" generally refers to an ink cartridge for an ink jet printer. An ink jet cartridge may be configured to include an inlet port that facilitates fluid communication with an interior chamber of the cartridge. The present invention utilizes such an inlet port of an ink cartridge to refill the cartridge using an easy-to-use method and apparatus, examples of which are described herein.

Figure 1:
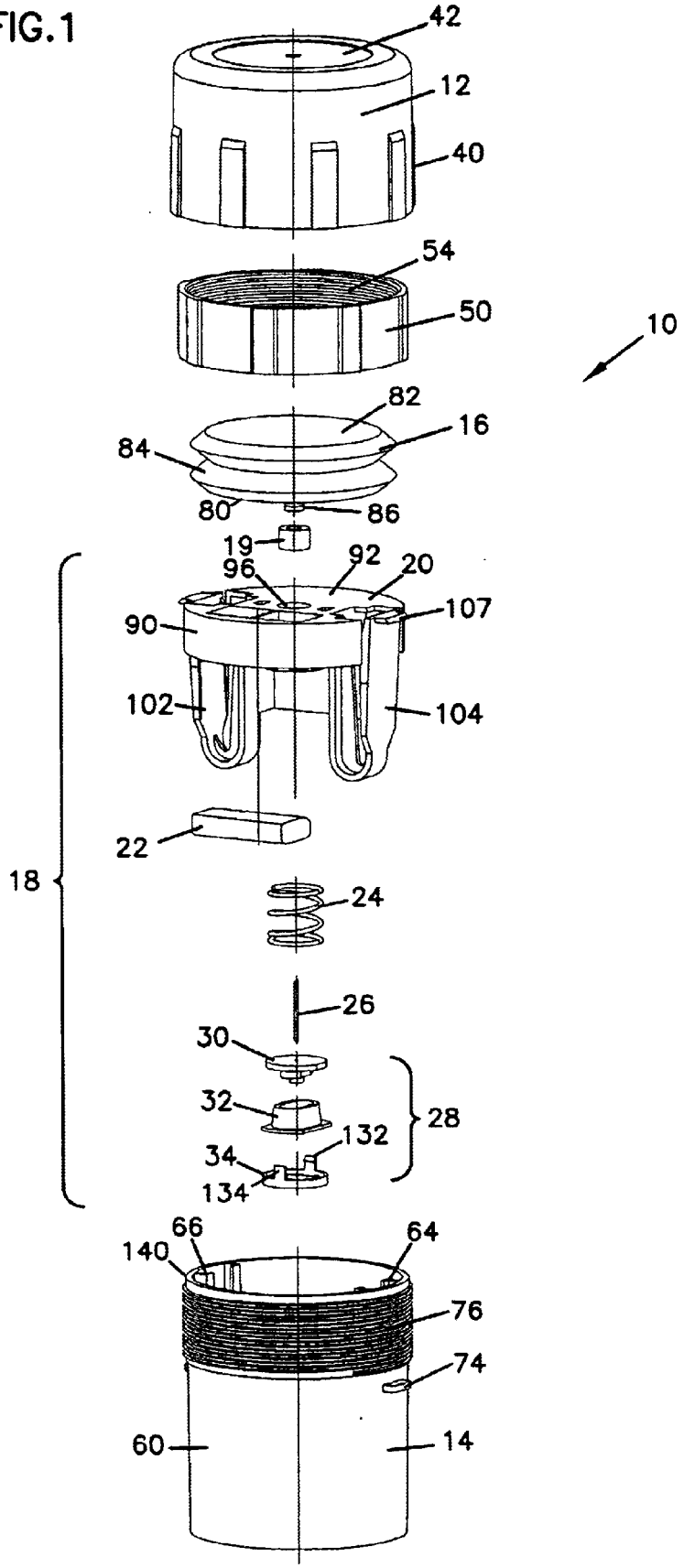
FIG. 1 is an exploded view of an ink refill apparatus including features that are examples of how certain inventive concepts can be put into practice.

An ink refill apparatus 10 is shown in exploded perspective view in FIG. 1. The apparatus 10 has numerous features that are examples of how inventive concepts disclosed herein can be practiced. Apparatus 10 includes a housing having a first housing member 12 and a second housing member 14 that may be moved relative to one another. Apparatus 10 also includes an ink pouch 16 and an ink transfer unit 18 that may be positioned within the housing so that when the first and second housing members 12 and 14 are moved relative to each other, ink flows from the ink pouch 16, through the ink transfer unit 18, and into an ink cartridge positioned within the housing.

Figure 3:
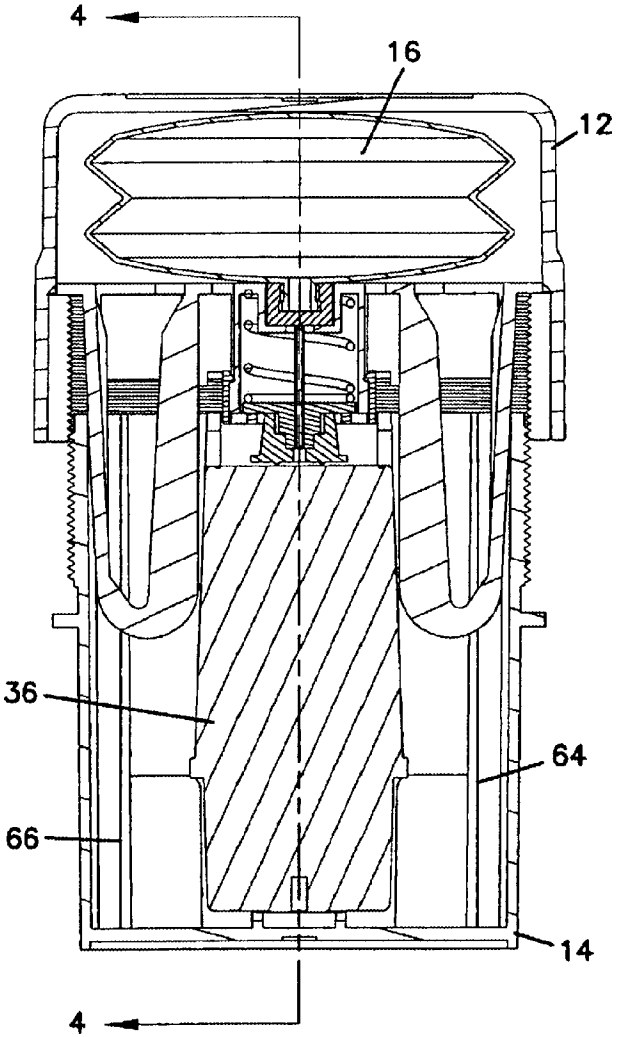
FIG. 3 is a cross-sectional view of the apparatus of FIG. 1 including an ink cartridge, the cross-sectional view is taken along section line 3—3.
Figure 2:
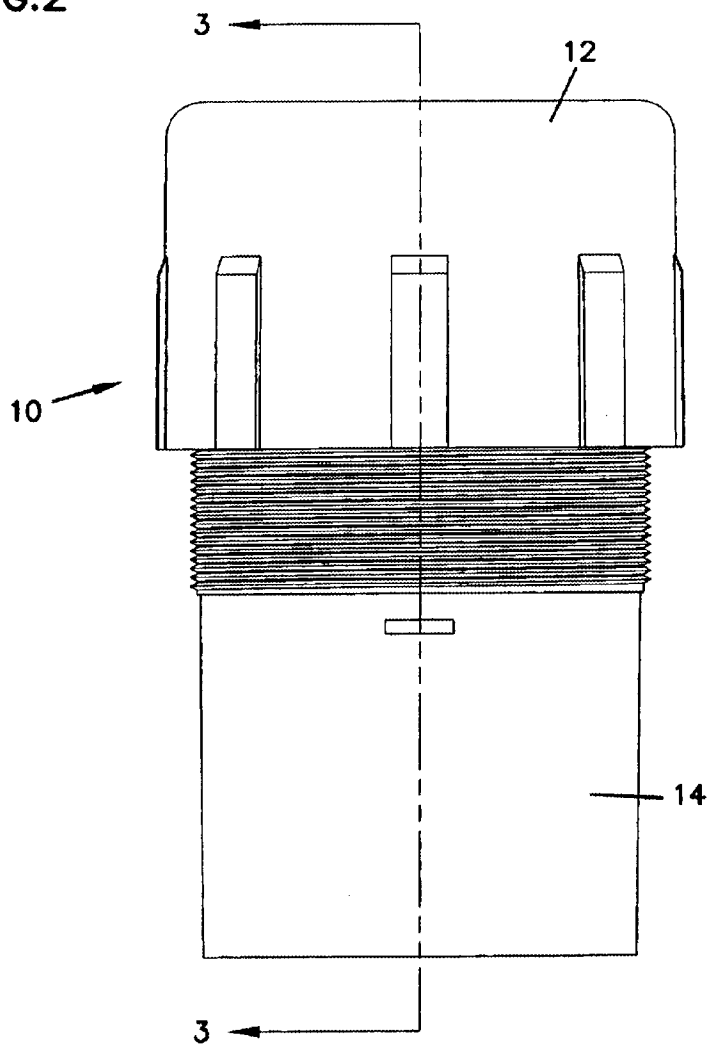
FIG. 2 is an assembled view of the apparatus of FIG. 1.
Figure 5:
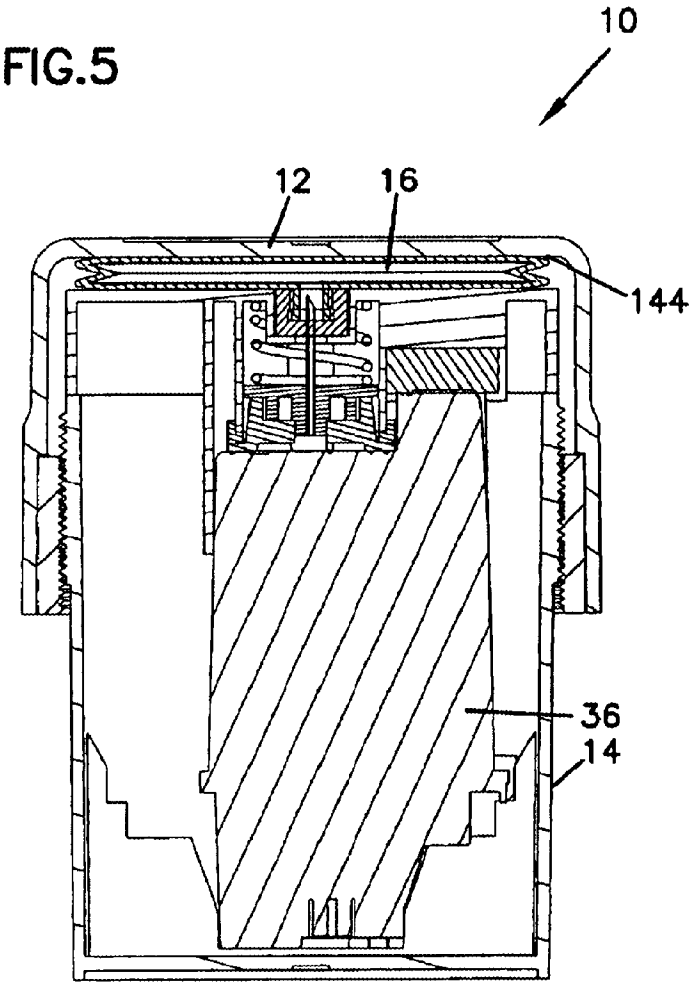
FIG. 5 is a side cross-sectional view of the apparatus of FIG. 3 in the compressed position.
Figure 4:
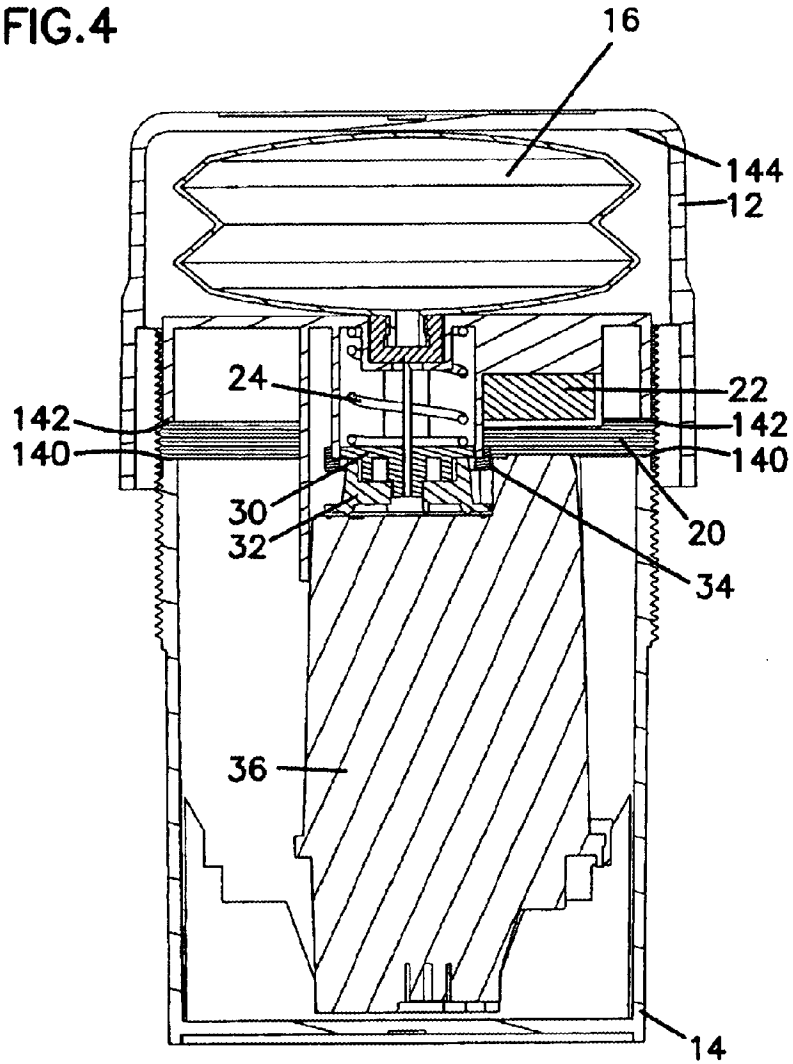
FIG. 4 is a cross-sectional view taken along section line 4—4 of FIG. 3, the apparatus is shown in the uncompressed position.

FIG. 2 illustrates the ink fill apparatus assembled together with the first and second members 12 and 14 secured together so that the housing and ink pouch are in an uncompressed state. FIG. 3 is a cross-sectional view along cross-section 3—3 of the assembled ink refill apparatus 10 shown in FIG. 2. FIG. 3 illustrates an ink cartridge 36 positioned in the second housing member 14 with the ink pouch in the uncompressed state. FIG. 4 is a further cross-sectional view along cross-section 4—4 shown in FIG. 3. When first and second housing members 12 and 14 are moved axially toward to each other, the ink pouch 16 is compressed, thereby causing ink to flow from the ink pouch 16 into the ink cartridge 36. FIG. 5 illustrates the ink fill apparatus 10 with the ink pouch 16 in a compressed position due to the movement of first and second housing members 12 and 14 toward each other.

Referring now to FIGS. 1 and 4, there are several additional features of the ink fill apparatus 10 that assist in providing ink flow between the ink pouch 16 and an ink cartridge 36 when using the ink fill apparatus 10. Ink transfer unit 18 may include an alignment structure 20, an overflow pad 22, a biasing member 24, a piercing structure 26, and a plunger assembly 28. The plunger assembly may include a conduit portion 30, a head portion 32, and a housing portion 34. The ink refill apparatus 10 may also include a threaded sleeve 50 insertable into first housing member 12, and a gasket 19 that interfaces with the ink pouch 16 and alignment structure 20.

Figure 6:
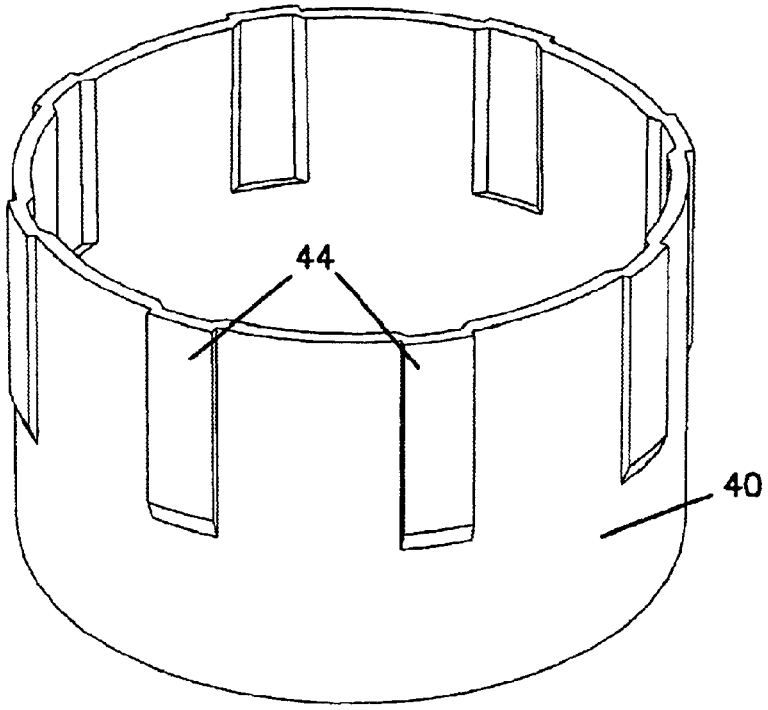
FIG. 6 is a perspective view of a first housing member of the apparatus of FIG. 1.

First housing member 12 has a generally cylindrical shape, as shown in FIGS. 1 and 6, with a side wall 40 and an end wall 42 (see FIG. 1). Slots 44 are formed on the side wall 40 at spaced locations around the circumference of the side wall. The slots 44 are configured to engage protrusions 52 provided at an exterior surface of threaded sleeve 50. Sleeve 50 mounts within housing member 12 by inserting sleeve 50 in housing member 12 such that protrusions 52 press-fit within slots 44.

Figure 7:
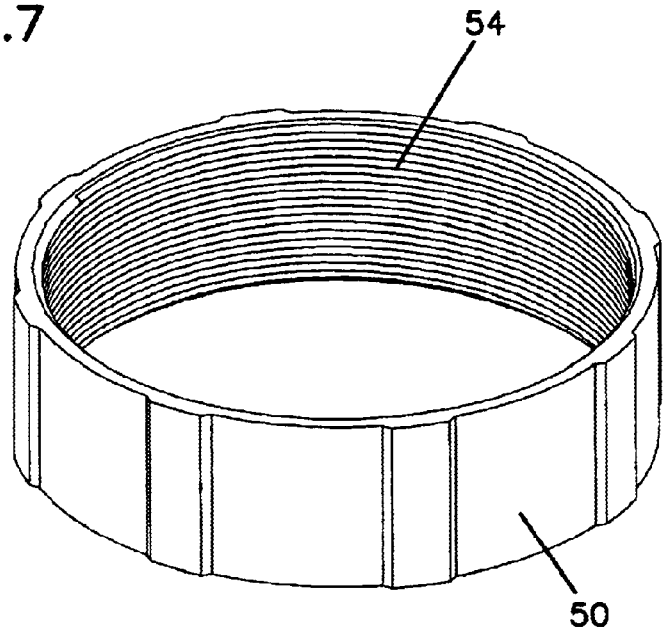
FIG. 7 is a perspective view of a threaded sleeve portion of the first housing member of FIGS. 1 and 6.

FIG. 7 illustrates one embodiment of a threaded sleeve 50 that may be used with the first housing member 12. In other embodiments, threads 54 may be integrally formed into first housing member 12, thus eliminated the need for a separate threaded sleeve member. In yet other embodiments, protrusions may be formed on the interior surface of first housing member 12 and slots may be formed on an exterior surface of threaded sleeve 50 to provide a similar connection as is provided in the embodiment illustrated in FIGS. 6 and 7. In yet further embodiments, the first housing member 12 may be cylindrical in shape with both ends open. In still further embodiments, the first housing member 12 may have a cylindrical portion with a circular cross-section at one end that includes threads, with an opposing end having, for example, a polygonal cross-section. Such an embodiment would provide for the threaded connection between the first and second housing members while being capable of housing different ink pouches designs, providing a gripping surface to make it easier to rotate the first housing member, or other design features.

Figure 10:
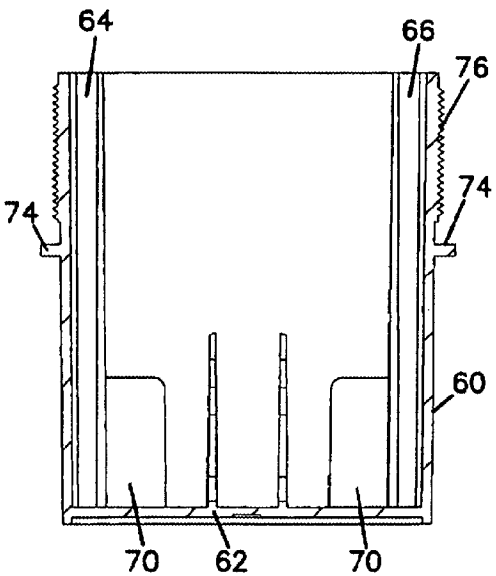
FIG. 10 is a side cross-sectional view taken along section line 10—10 of FIG. 8.
Figure 9:
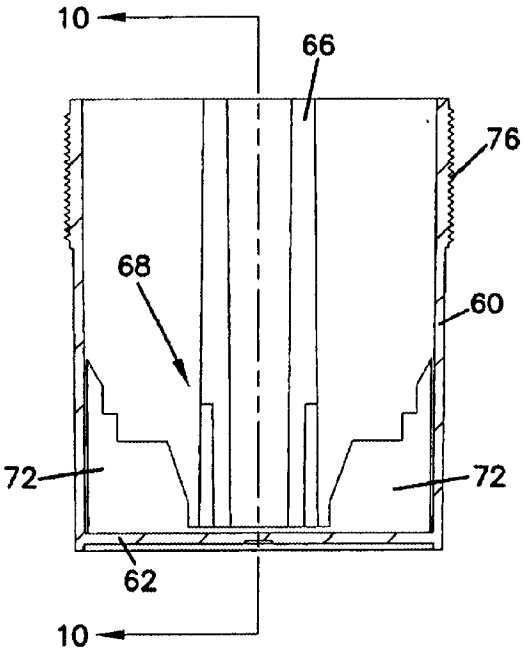
FIG. 9 is a cross-sectional view taken along section 9—9 of FIG. 8.
Figure 8:
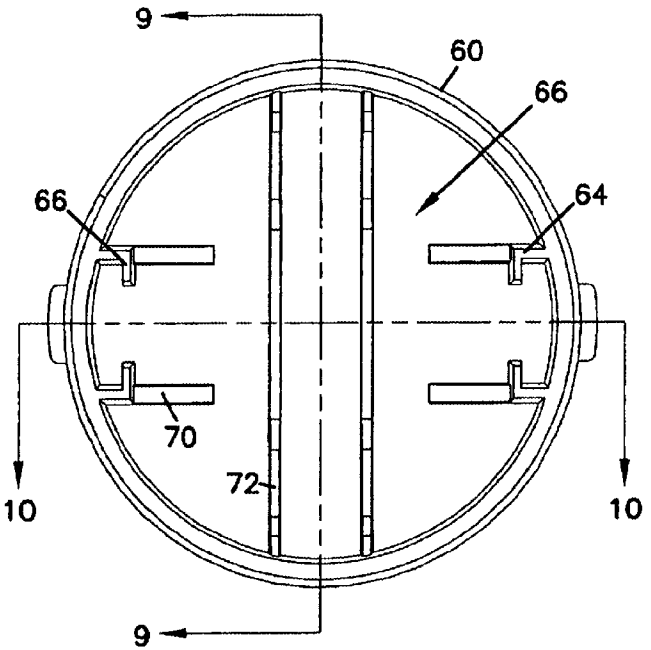
FIG. 8 is a top view of a second housing member of the apparatus of FIG. 1.

The second housing member 14 is shown in the top, front, and side views of FIGS. 8–10, respectively, and the perspective view of FIG. 1. In this embodiment, the second housing member 14 is also generally cylindrically shaped with a circular cross-section and includes a side wall 60, an end wall 62, opposing first and second track portions 64 and 66, and a seat structure 68 positioned within the housing member near end wall 62. The seat portion 68 includes supports 70 extending from the first and second track portions 64 and 66 and contoured structures 72 arranged approximately perpendicular to supports 70 so that the seat portion contacts an ink cartridge to be positioned within second housing member 14 on four sides. Thus, the seat portion 68 may be configured differently for different ink cartridge designs, but should preferably be configured to hold the ink cartridge from rotating within the second housing member.

The second housing member 12 may also include position stops 74 at spaced locations around an exterior circumference of side wall 60 at a position adjacent a threaded portion 76 of the second housing member. The threads 76 are configured to engage the threads 54 formed on the interior of threaded sleeve 50 positioned within first housing member 12. The position stops 74 ensure that the first housing member will be threaded onto the second housing member a fixed distance determined by the position of the stops 74.

As with the first housing member 12, the second housing member 14 may have alternative design configurations while maintaining a threaded interface for engaging threaded surface 54 of first housing member 12. For example, the side wall near end wall 62 may have, for example, a polygonal cross-section or may be configured to have openings formed at spaced locations around a circumference of the side wall so that the housing is partially open.

In yet further housing embodiments, the first and second housing members may be connected with alternative connecting structure besides threaded male and female parts, as is shown in FIGS. 1–10. For example, the first and second housing members may be connected with, for example, an incremental snap-fit connection, a ratchet mechanism, or a bracket, or may be designed so that the first and second housing members are insertable one into the other with a minimal interference fit so that a user can simply exert forces at either end of the housing to compress the first and second housing members together. In other embodiments, the pieces could be pulled or moved apart to generate compressive forces. In each embodiment, the first and second housing members are preferably axially aligned so that the first and second housing members move smoothly and in a predictable direction relative to one another. The examples provided herein for such a housing may provide this result. However, these examples should not be limiting as to the many different designs possible to create the necessary compression forces.

Figure 11:
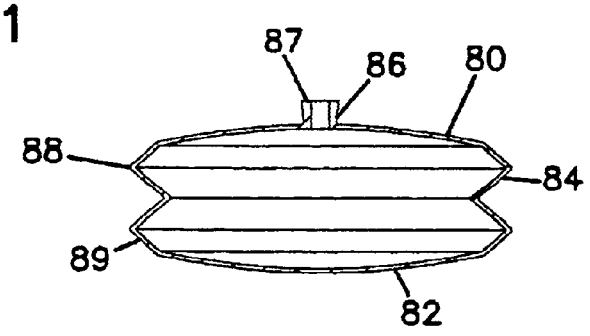
FIG. 11 is a cross-sectional view of an ink container of the apparatus of FIG. 1.

Referring now to FIGS. 1 and 11, ink pouch 16 includes a first side 80, a second side 82, a side wall 84, and an inlet/outlet 86. This embodiment of ink pouch 16 is intended to be compressible in a direction between the first and second sides 80 and 82. In this embodiment, the side wall 84 has an "accordion" design that permits the ink pouch to be essentially flattened when a compression force is exerted on the pouch at the first and second sides 80 and 82. Compression of the ink pouch forces ink from the pouch through the inlet/outlet 86. The inlet/outlet 86 may be covered with a temporary seal to prohibit accidental flow of ink from the pouch. When fully compressed, the volume within the pouch is substantially eliminated such that substantially all of the ink is forced to exit the pouch.

The side wall 84, in this embodiment, includes two "folds" 88 and 89. In other embodiments, there may be one or multiple folds and in the ink pouch may have a wide range of thicknesses measured between the first and second sides of the ink pouch. According to this embodiment, ink pouch 16 is generally cylindrically shaped with a circular cross-section having a circumference of about 4–8 cm and a thickness of about 1–3 cm. Preferably, ink pouch 16 has a circumference approximately 6.5 cm and a thickness of approximately 2 cm. In alternative embodiments, the ink pouch may have an oval or polygonal cross-section with different dimensions and a different side wall configuration for use with various housing and ink transfer unit configurations. The pouch is preferably made of a bendable/deformable plastic material.

When the ink pouch is used with ink fill apparatus 10 of the present invention, a pierceable gasket 19 (shown in FIG. 1) may be positioned over the inlet/outlet 86 such that a piercing structure can pass through the gasket and into fluid communication with the ink pouch. Such a gasket may be reusable so that it reforms a seal when a piercing member is removed from the ink pouch. In other embodiments, a separate gasket 19 may be eliminated by covering an end 87 of the inlet/outlet with a pierceable material, such as the material gasket 19 is made from, during the manufacturing process. In a yet further embodiment, a gasket or other sealing structure may be mounted in the ink transfer unit so that the ink pouch can be unsealed when connected to the ink transfer unit for operation within the ink refill apparatus.

Referring now to FIGS. 1 and 12–14, alignment structure 20 includes a first side 92 (shown in FIG. 1), a second side 94 (shown in FIG. 12), a pouch opening 96, a plunger opening 98, an overflow recess 100, first and second adjustment clips 102 and 104, adjustment tabs 106 and 107, and flanges 108 and 109. The first side 92 is substantially flat and configured to interface with a first side 80 of ink pouch 16. First side 92 includes opening 96 that is configured to engage the inlet/outlet 86 and/or the gasket 19 secured to the inlet/outlet of the ink pouch (see FIG. 4). Preferably, the opening 96 is sized to create an interference fit between inlet/outlet 86 of the ink pouch or gasket 19 and the ink transfer unit in order to hold the ink pouch and ink transfer unit together when assembling the ink refill apparatus. In other embodiments, the opening 96 may not be required, or may be required only for providing a recess area for the piercing structure 26 to retract into.

The second side 94 includes plunger opening 98 that is sized to receive a portion of plunger assembly 28 (see FIG. 4). The plunger opening 98 includes an opening into pouch opening 96 (shown in FIG. 14). The plunger opening 98 may have a shape different than the generally cylindrical opening with a circular cross-section shown in FIG. 12. For example, if the plunger assembly were to have a rectangular or polygonal cross-section, the plunger opening would be configured to substantially match the cross-sectional shape of the plunger assembly parts that are inserted into the plunger opening.

Alignment structure 20 also includes recess 100 to which the overflow pad 22 (shown in FIG. 1) may be mounted. In a preferred embodiment, the overflow pad 22 is positioned adjacent the print head of ink cartridge 36 when the ink cartridge is mounted within ink refill apparatus 10. As ink flows from ink pouch 16 into the ink cartridge 36 during use of the ink refill apparatus, the overflow pad absorbs excess ink that may be discharged from the ink cartridge print head.

Alignment structure 20 also includes first and second adjustment clips 102 and 104 that may be used to adjustably position the ink transfer unit relative to the first and second housing members. The first and second adjustment clips may include tabs 106 and 107, respectively, that engage a portion of first housing member 12. For example, the tabs may engage the internal threads 54 of threaded sleeve 50, thus providing incremental axial positioning of the ink transfer unit within the first housing member. Applying a radially inward directed force to the first and second adjustment clips will release or loosen the tabs from the first housing member to facilitate quick and easy removal and/or positioning of the ink transfer unit relative to the housing.

The first and second adjustment clips may also include flanges 108 and 109 that are configured to fit within the first and second track portions 64 and 66 of the second housing member 14 (see FIG. 4). When engaging the flanges 108 and 109 in the first and second track portions 64 and 66, the ink transfer unit 18 is fixed from rotating within the housing member 14 while still permitting axial movement of the ink transfer unit within the housing and also permitting rotational movement between the first and second housing members. According to the embodiment illustrated in FIGS. 1–12, this type of ink transfer unit configuration is advantageous for aligning the inlet/outlet 86 of ink pouch 16 with an inlet port of ink cartridge 36 while still allowing the first and second housing members to move relative to each other to cause compression of the ink pouch that results in refilling of the ink cartridge with ink from ink pouch 16.

The alignment structure 20 may, in other embodiments, include features that are equivalent to the first and second adjustment clips. For example, the alignment structure 20 may include protrusions that engage slots formed in the side wall of the first and second housing members that provide the necessary alignment of the ink pouch, ink transfer unit, and ink cartridge while allowing compressive movement between the first and second housing members.

Figure 15:
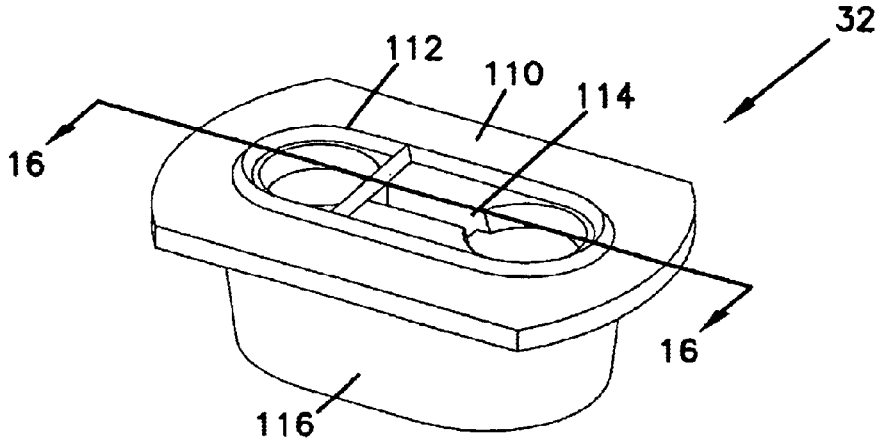
FIG. 15 is a perspective view of a head portion of a plunger assembly of the apparatus of FIG. 1.
Figure 16:
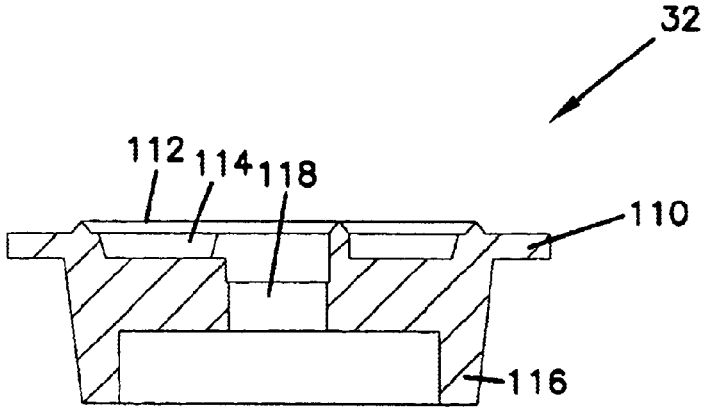
FIG. 16 is a cross-sectional view taken along section line 16—16 of FIG. 15.
Figure 12:
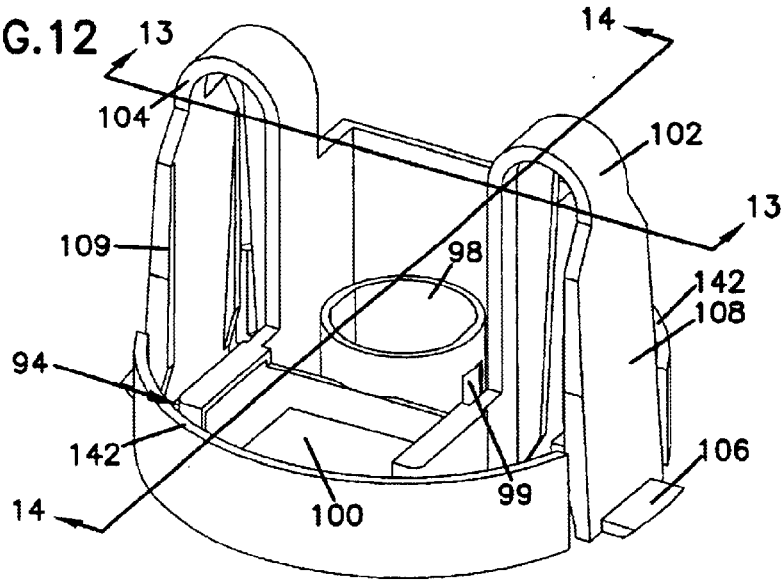
FIG. 12 is a perspective view of an alignment structure of the apparatus of FIG. 1.
Figure 13:
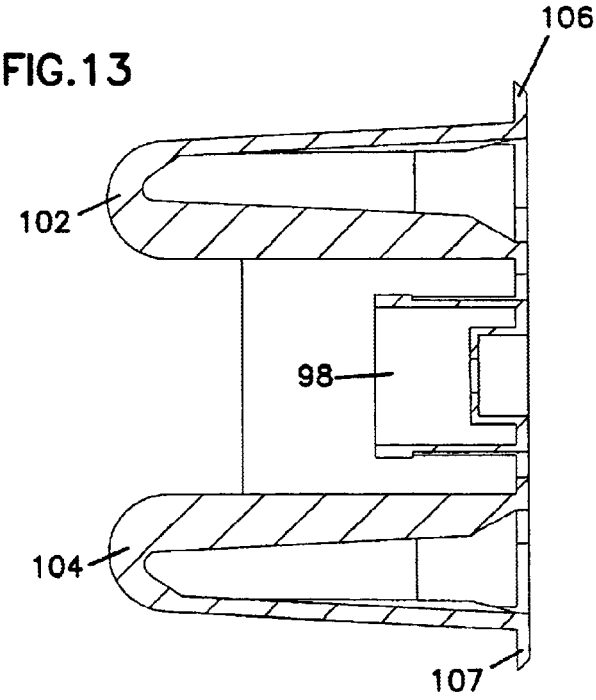
FIG. 13 is a cross-sectional view taken along section line 13—13 of FIG. 12.
Figure 14:
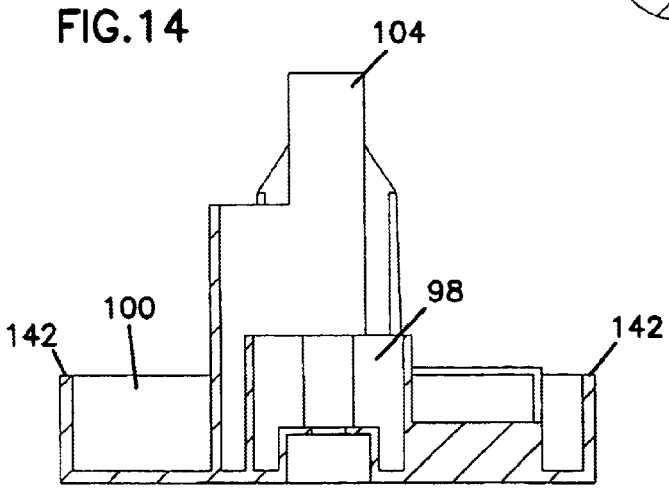
FIG. 14 is a cross-sectional view taken along section line 14—14 of FIG. 12.

Referring now to FIGS. 1, 15 and 16, the head portion 32 of plunger assembly 28 includes a platform 110, a seal 112, a trough 114, a base 116, and an opening 118. The platform 110 provides a relatively planar surface for mounting seal 112. The seal is configured to engage a surface of the ink cartridge 36 adjacent an opening into the ink cartridge so that ink flowing from the ink transfer unit to the ink cartridge will be contained in that area around the inlet defined where the seal contacts the ink cartridge. The head portion also includes an opening 118 that provides fluid communication between the base 116 and the platform 110. The opening 118 is also connected to trough 114 so that ink flows in the trough from the opening 118 to the inlet of the ink cartridge. The base 116 is configured with an opening that is capable of receiving the conduit portion 30 of the plunger assembly 28 (as shown in FIG. 4).

Figure 17:
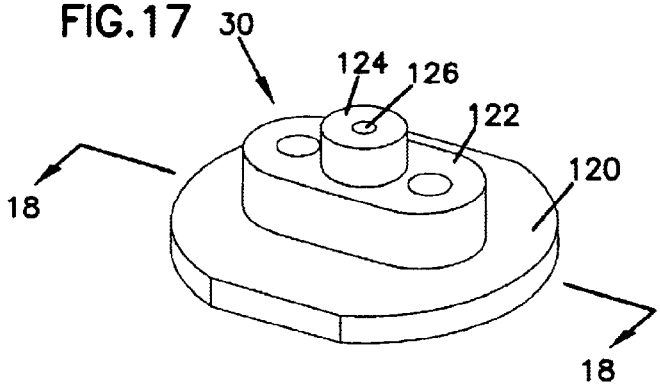
FIG. 17 is a perspective view of a conduit portion of the plunger assembly of the apparatus of FIG. 1.
Figure 18:
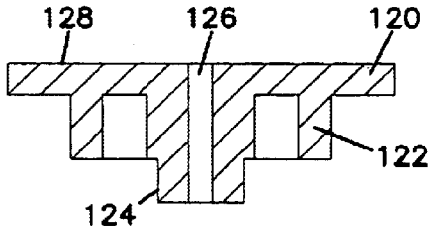
FIG. 18 is a cross-sectional view taken along section line 18—18 of FIG. 17.
Figure 19:
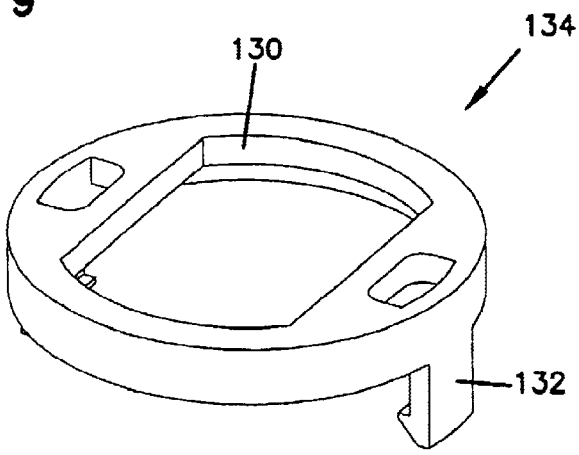
FIG. 19 is a perspective view of a plunger housing of the apparatus of FIG. 1.

Referring to FIGS. 17 and 18, conduit portion 30 includes a base 120, a first protrusion 122, a second protrusion 124, and a conduit 126 extending through the first and second protrusions. The base portion 120 may include a relatively planar surface 128 that faces in the direction of ink pouch 16. The first and second protrusions 122 and 124 are configured to be inserted into opening 118 of head portion 32 (see FIG. 4). Preferably, the fit between the first and second protrusions and the head portion 32 creates a fluid seal, so that when the conduit portion 30 and head portion 32 are secured together, fluid passing through conduit 126 only may exit through trough 114 of the head portion.

The platform 110 of head portion 32 and base portion 120 of conduit 30 are configured so that when connected together, there is a space sufficient for a plunger housing portion 34 to fit therebetween. The plunger housing portion includes an opening 130 configured to receive the base portion 116 of head portion 32. The housing portion also includes attachment arms 132 and 134 that secure the head portion to the alignment structure 20 via attachment recesses 99 adjacent opening 98 (see FIG. 12). When plunger housing portion 34 is snap-fit in place to the alignment structure 20, the plunger assembly has limited available axial movement and is restrained from making rotational movement. A biasing member 24 (see FIG. 1) is preferably positioned between the base portion 120 and the first side 92 of alignment structure 20. The biasing member 24 provides a biasing force against the plunger assembly to bias it in a direction away from the ink pouch 16. The piercing structure 26 is configured to be inserted into conduit 126 of conduit portion 30 and through bladder 19 into the inlet/outlet 86 to create fluid communication between trough 114 and the ink pouch 16 (see FIG. 5). In a preferred embodiment, the piercing structure 26 is fixed to conduit portion 30 so that the biasing member 24 also biases the piercing structure 26 away from the ink pouch 16.

In other embodiments, the plunger assembly may be configured differently, with fewer or more pieces having some differences from the illustrated embodiment. In operation, the platform 110 of head portion 32 engages an ink cartridge to form a seal around an inlet to the ink cartridge and the piercing structure 26 pierces bladder 19 to create ink flow between the ink pouch and the ink cartridge as the first housing member 12 is moved towards the second housing member 14.

Figure 20:
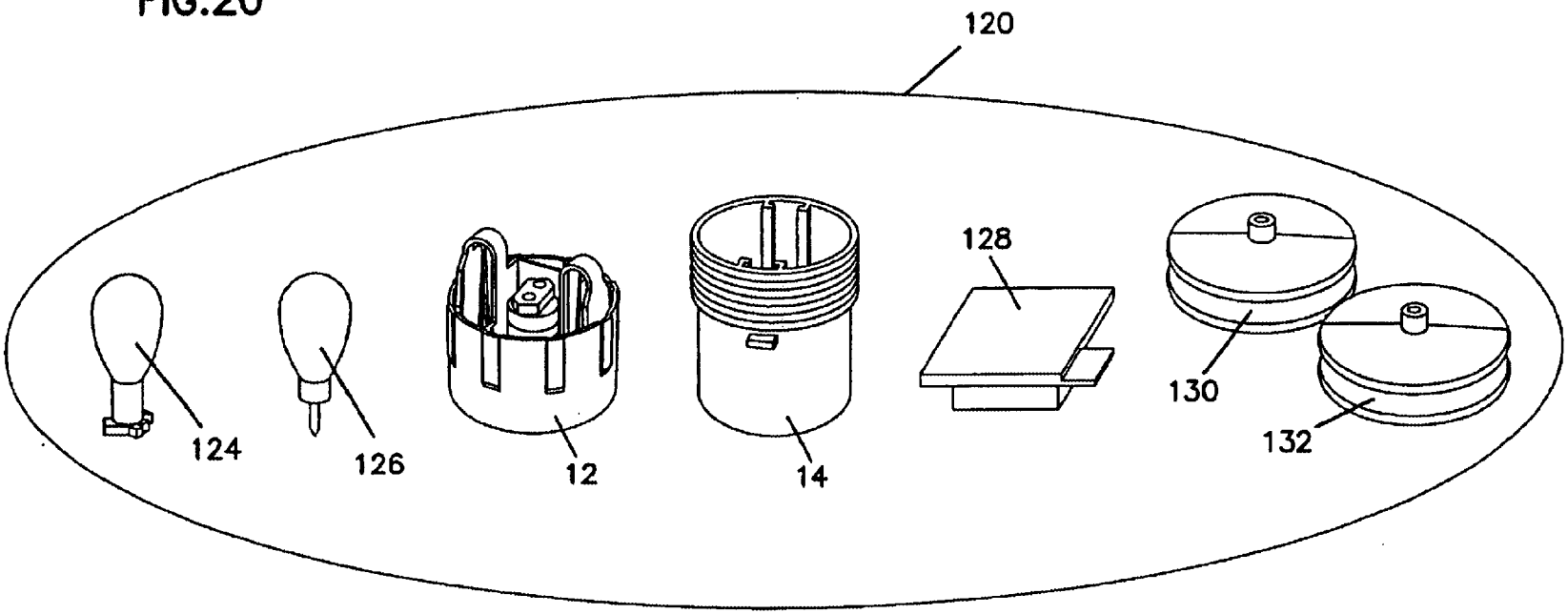
FIG. 20 is a perspective view of a kit including the apparatus of FIG. 1.

A kit that includes the ink refill apparatus 10, as shown in FIG. 20, may include a package 120, a compression device having first and second housing members 12 and 14, a suction bulb 124, a blower 126, a cleaning fluid 128, and ink containers 130 and 132. The package 120 may be a box, bag, or the like that holds the kit components together. The suction bulb 124 may be configured to create a seal around a vent hole or around the print head on a bottom end of the ink cartridge so that the suction bulb 124 can apply a suction force to remove unwanted ink that may be lodged therein. The use of suction bulb 124 may be more effective after soaking the cartridge bottom end in cleaning fluid 128. The blower 126 may be used, for example, to force ink out of the print head by inserting an end of blower 126 into a center hole on a top end of the ink cartridge, and then squeezing the bulb. In other kit embodiments, the blower and suction devices may be integrated into a single device. In yet further kit embodiments, one or more kit components may not be required or additional kit components may be added. For example, the cleaning fluid 128 or one of the ink containers 130 and 132 may not be included, or the kit may include three or more ink containers.

Figure 21:
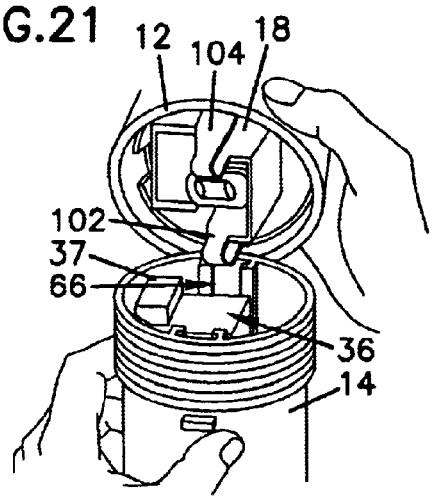
FIG. 21 is a perspective view of one step in a method of using the apparatus of FIG. 1.
Figure 22:
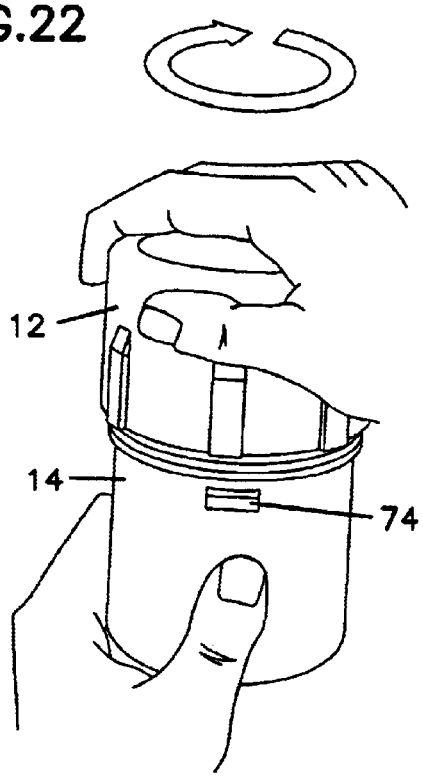
FIG. 22 is a perspective view of another step in a method of using the apparatus of FIG. 1.
Figure 23:
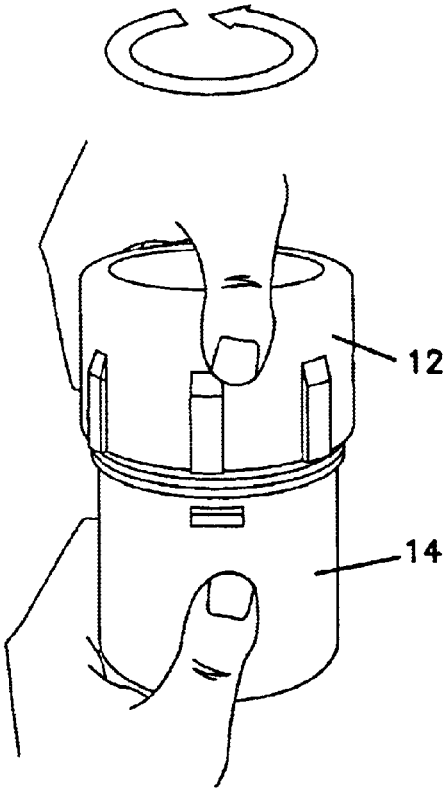
FIG. 23 is a perspective view of yet another step in a method of using the apparatus of FIG. 1.
Figure 24:
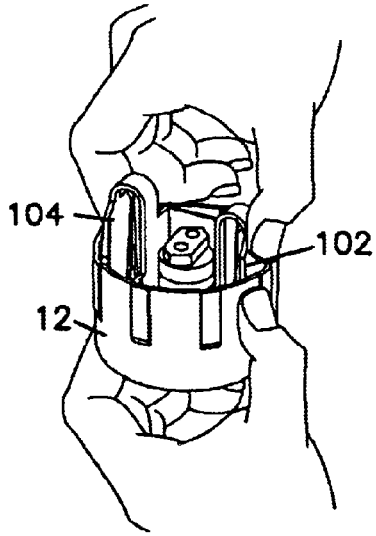
FIG. 24 is a perspective view illustrating a user removing the ink transfer unit from the second housing member.

According to a method of using the ink refill apparatus 10 of the present invention, the apparatus is assembled and used according to the steps shown in FIGS. 21–23. An ink cartridge 36 is installed in the second housing member 14 with the cartridge print head 37 facing upward (see FIG. 21). Ink pouch 16 is mounted to ink transfer unit 18 and then positioned in first housing member 12. The first and second adjustment clips 108 and 109 of ink transfer unit 18 are inserted into first and second track portions 64 and 66 of the second housing member 14 and the first and second housing members 12, 14 are moved toward one another until the threaded portions 54 and 76 of the housing members 12 and 14 engage (see FIG. 22). The first housing member 12 is then rotated clockwise relative to the second housing member 14 (see FIG. 23).

When the first and second housing members 12, 14 are rotated clockwise relative to each other (see FIG. 22), there is an internal sequence of moving parts that ultimately produce fluid flow between ink pouch 16 and ink cartridge 36. For example, the relative axial positioning of head portion 32 and first side 92 of alignment structure 20 is significant (see FIGS. 4 and 5). These features are relatively positioned such that when the first and second housing members 12 and 14 are threaded together, plunger assembly 28 is moved within alignment structure 20 toward ink pouch 16 causing biasing member 24 to collapse and piercing member 26 to engage and pierce gasket 19. After plunger assembly 28 is completely compressed within alignment structure 20 and gasket 19 is pierced, a circumferential end surface 140 (see FIG. 1) of housing member 14 engages an end surface 142 (see FIGS. 12 and 14) of alignment structure 20 (see FIGS. 4 and 5). Further clockwise rotation of the first and second housing members 12 and 14 relative to each other causes first side 92 to compress ink pouch 16 against end surface 42 of first housing member 12 to force ink from ink pouch 16 through piercing member 26, plunger assembly 28 and into ink cartridge 36.

When there begins to be resistance to clockwise motion (while ink pouch 16 is being compressed), a user must stop turning for a few seconds to allow ink flow from ink pouch 16 into ink cartridge 36 without ink being forced around seal 112. This process of making clockwise turns and pausing continues until the first housing member can no longer turn in a clockwise direction (see FIG. 5), at which time the ink pouch has been completely compressed and the ink cartridge filled with ink. Next, a user unscrews first and second housing members 12 and 14 by turning them in a counter-clockwise direction relative to each other while keeping apparatus 10 in the upright position (see FIG. 23) until they are released from one another. The user may then wipe away any excess ink from cartridge 36 and remove the filled cartridge from apparatus 10. If ink cartridge 36 is not full, the empty ink pouch 16 may be replaced with a full ink pouch 16 by compressing the first and second adjustment clips 102 and 104 of alignment structure 20 towards each other to release ink transfer unit 18 from first housing member 12 (shown in FIG. 24). A full ink pouch 16 is then mounted to alignment structure 20 and ink transfer unit 18 is reinserted into first housing member 12 in preparation for engaging first and second housing members 12 and 14 to begin the refilling steps.

When unscrewing first and second housing members 12 and 14 from each other, the empty ink pouch 16 begins to expand, sucking air out of cartridge via plunger assembly 28, which is still engaging cartridge 36. Preferably, ink pouch 16 is fully expanded before plunger assembly 28 is detached from cartridge 36 to create necessary negative pressure within cartridge 36.

Sucking air out of filled cartridge 36 is one way to prevent ink from leaking out of the print head 37 or the inlet port of cartridge 36. The ink cartridges refilled with ink using ink refill apparatus 10 typically have no foam inside. Ink is retained in cartridge 36 by sub-atmospheric pressure. In some ink cartridge designs, air enters the cartridge to fill the void when ink is consumed by exiting through print head 37. However, the ink cartridge typically used with ink refill apparatus 10 is designed so that air enters into a flexible bag (not shown) positioned inside cartridge 36 through a hole on the top of the cartridge (at an opposite end from the print head). The flexible bag expands to fill the void left in the ink cartridge as ink is being used up. Typically, a spring is built into a wall of the bag to prevent the bag from expanding beyond a predetermined size. Preventing the bag from expanding beyond a certain size produces sub-atmospheric pressure inside cartridge 36, thereby preventing unwanted removal of ink from print head 37 and the fill hole on the bottom of cartridge 36.

If the user unscrews upper housing member 12 from lower housing member 14 very slowly, the applied suction force may suck out too much air from cartridge 36 so that the ink in print head 37 is also sucked back into cartridge 36. Then, when the user takes cartridge 36 from second housing member 14, print head 37 has no ink, and because of the negative pressure inside cartridge 36, ink typically will not flow into the print head. To remedy this problem, blower 136 may be inserted into the hole on top of cartridge 36 to expand the bag and force ink into print head 37 and into the fill hole on the bottom of cartridge 36. When blower 136 is removed, the bag contracts again and the inside of cartridge 36 returns to a sub-atmospheric state.

If the user unscrews first housing member 12 from second housing member 14 too fast, not enough air will be removed from cartridge 36 to create necessary sub-atmospheric pressure, thereby possibly allowing ink to leak from print head 37 and the fill hole on the bottom of cartridge 36 when the user removes cartridge 36 out of second housing member 14. As a result, the user may have to turn cartridge 36 upside down and use suction bulb 124 to remove air from cartridge 36 via the fill hole.

After completing this process of filling ink cartridge 36, the user may check for ink flow from print head 37. If there is not ink already showing on print head 37 (which would indicate that ink cartridge 36 is ready for use), the user may imprint or press print head 37 on a tissue to see if there is any ink in the print head that will flow into the tissue. If there is no ink in print head 37, the user may force ink into print head 37 by inserting blower 126 into a breather hole on ink cartridge 36 at an opposite end from print head 37. By squeezing a bulb of blower 126, ink is forced into print head 37. When ink appears on print head 37 or if ink flows onto a tissue against which print head 37 is imprinted, cartridge 36 is ready for use.

When cleaning print head 37 prior to refilling with ink, a user may soak the print head in cleaning fluid 128 and then apply a suction force against print head 37 with suction bulb 124 or another like apparatus to remove any unwanted ink from print head 37. Removal of unwanted ink from the print head may enhance ink flow from print head 37 after refilling ink cartridge 36. In an embodiment where ink cartridge 36 is refilled through print head 37, cleaning the print head prior to refilling may be essential for proper ink flow into ink cartridge 36.

Figure 25:
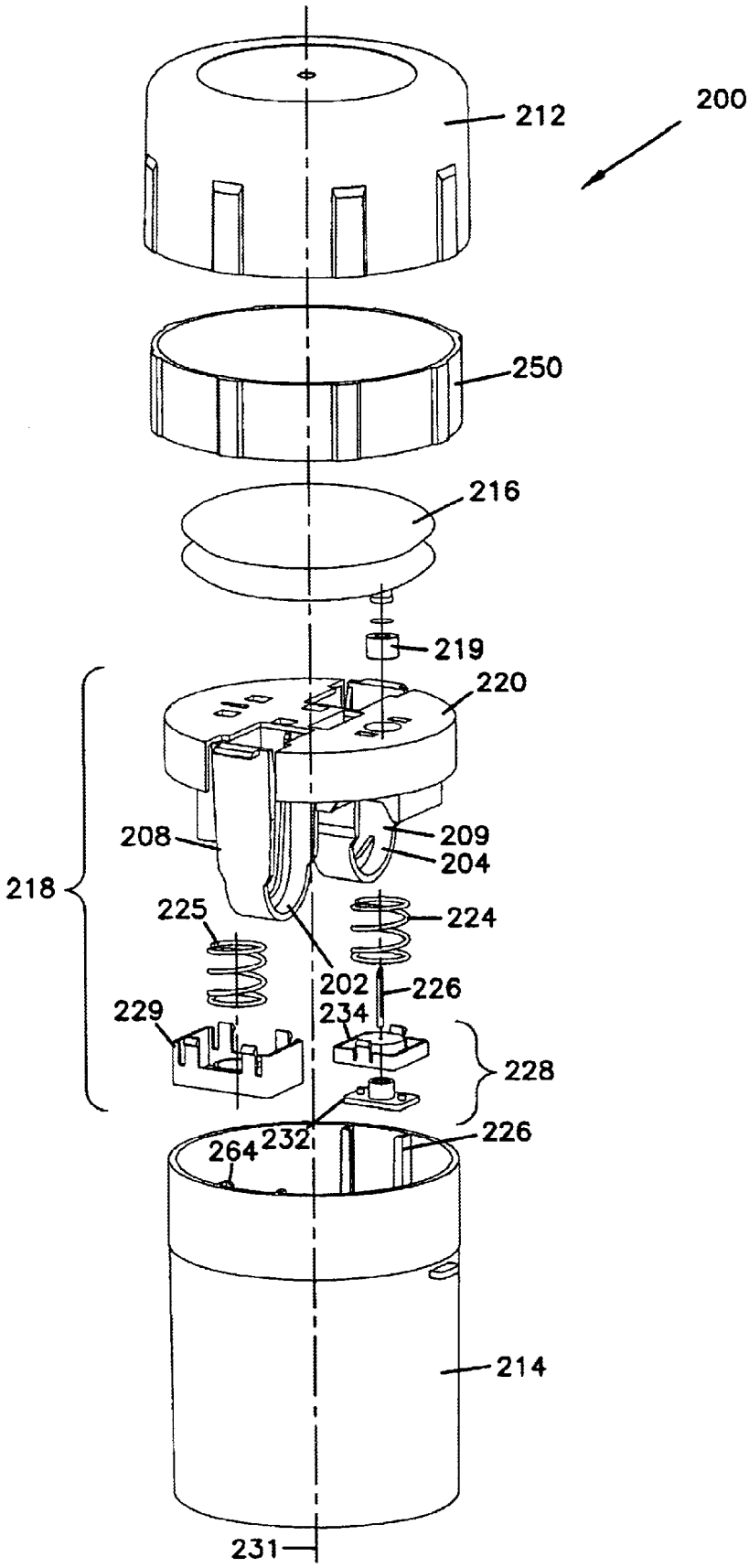
FIG. 25 is an exploded view of an alternative ink refill apparatus including features that are examples of how certain inventive concepts can be put into practice.
Figure 26:
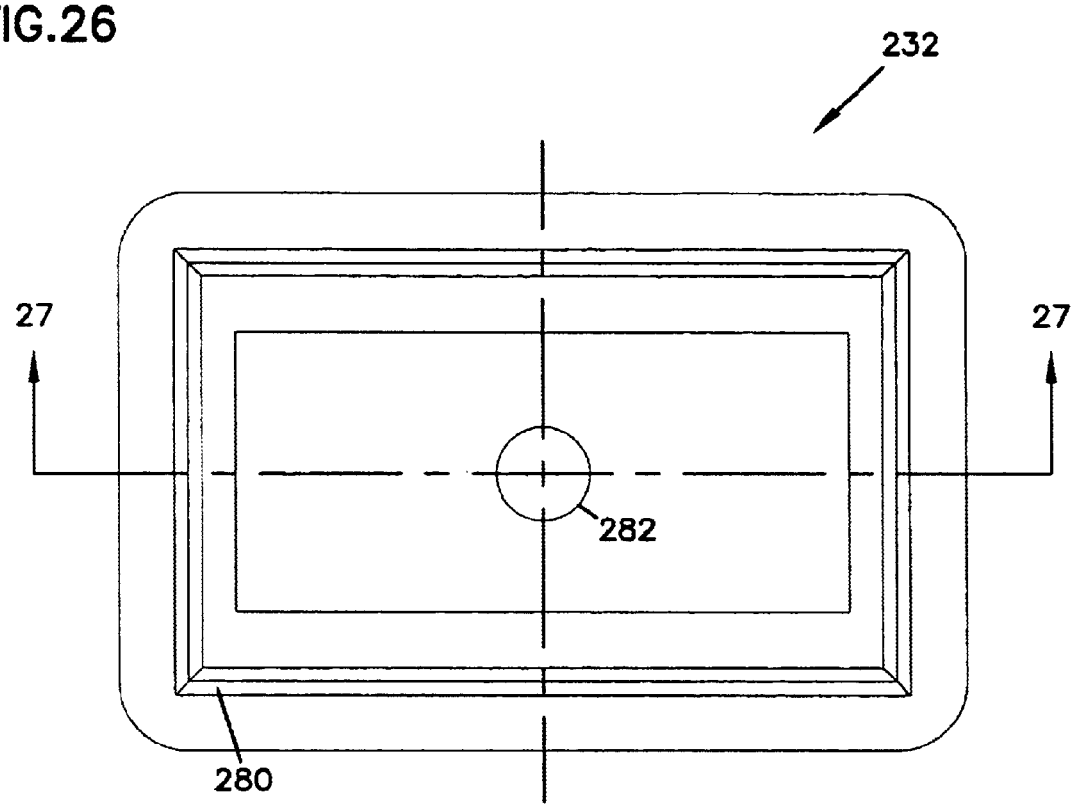
FIG. 26 is a perspective view of a head portion of a plunger assembly of the apparatus of FIG. 25.
Figure 27:
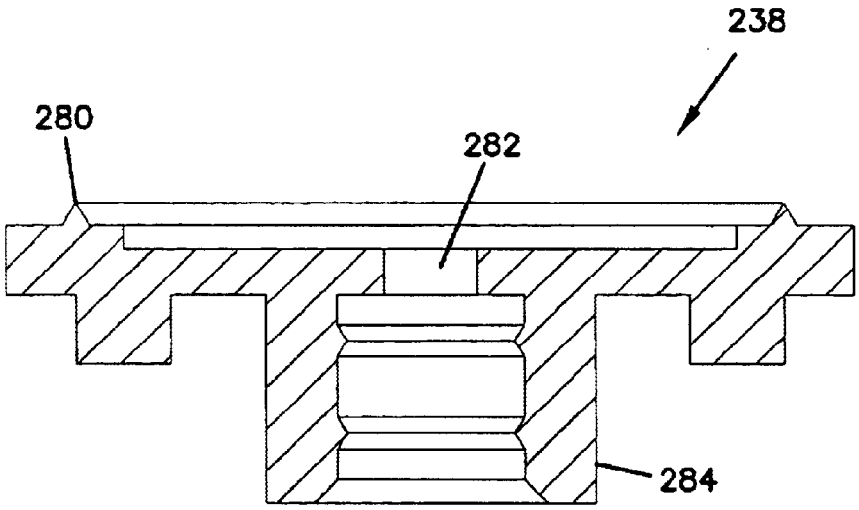
FIG. 27 is a cross-sectional view taken along section line 27—27 of FIG. 26.
Figure 28:
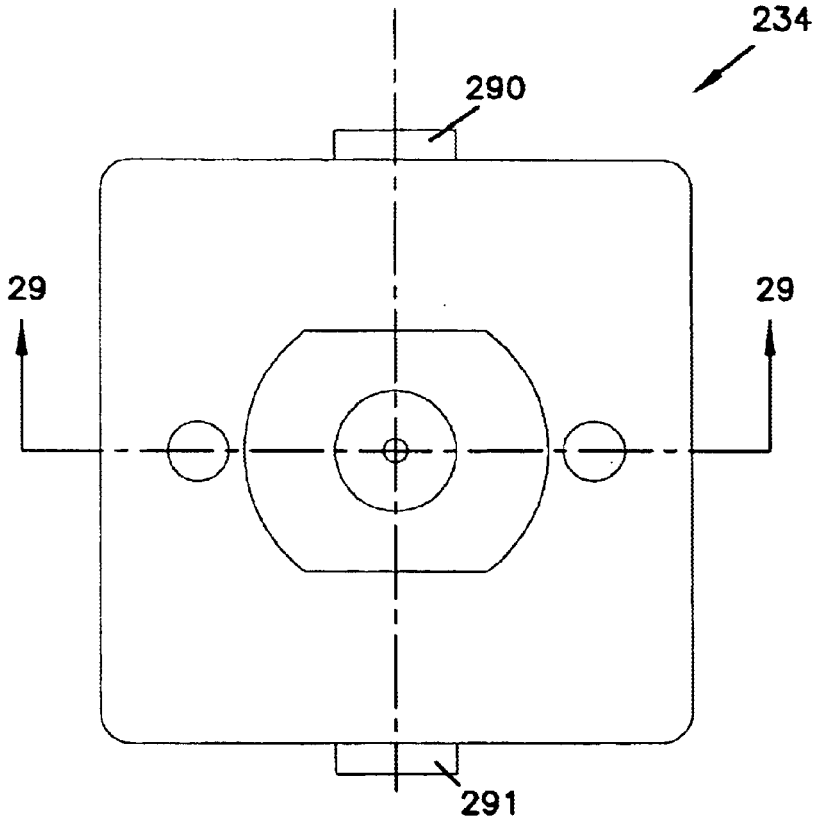
FIG. 28 is a perspective view of a housing portion of a plunger assembly of the apparatus of FIG. 25.
Figure 29:
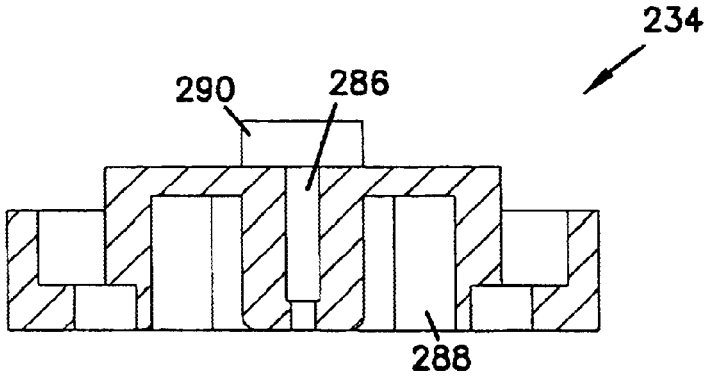
FIG. 29 is a cross-sectional view taken along section line 29—29 of FIG. 28.
Figure 30:
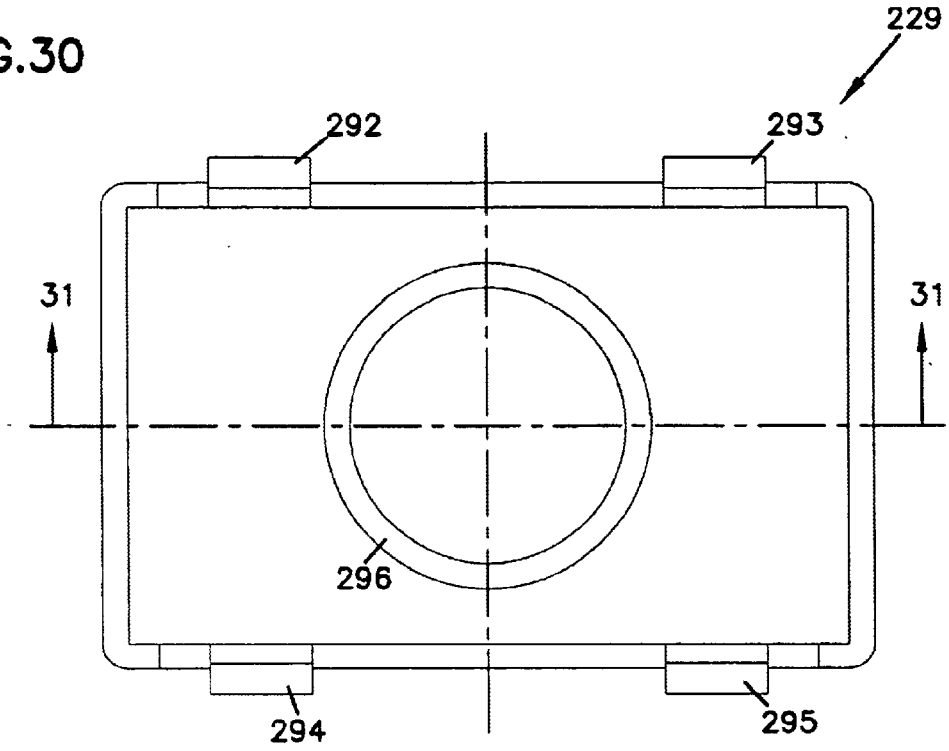
FIG. 30 is a perspective view of a head portion of a plunger assembly of the apparatus of FIG. 25.
Figure 31:
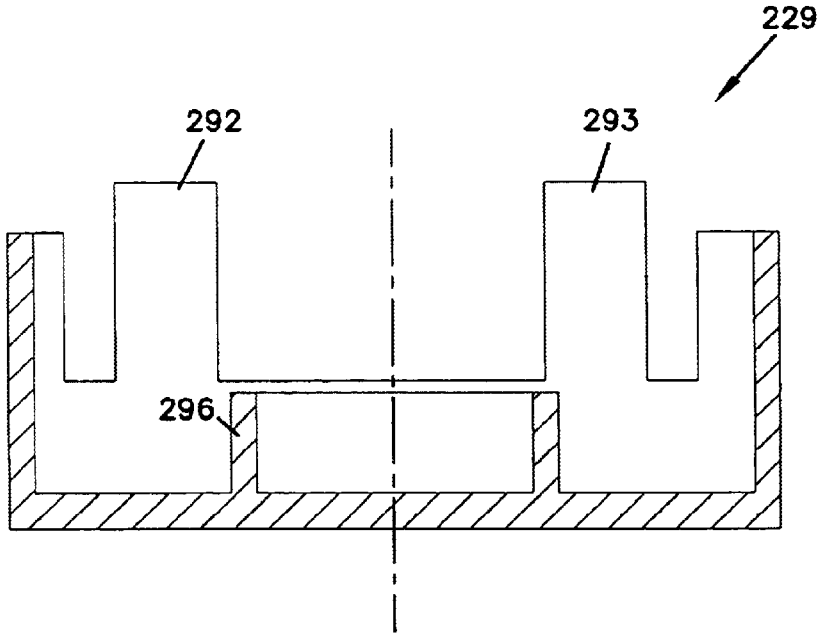
FIG. 31 is a cross-sectional view taken along section line 31—31 of FIG. 30.

Another example of an ink refill apparatus 200 is shown in the exploded perspective view of FIG. 25. The embodiment 200 of FIG. 25 is adapted for refilling ink cartridges by forcing ink into the cartridges through the cartridge print heads. Where possible, like numbers are used in FIG. 25 for like features shown in FIGS. 1–24. Apparatus 200 includes a housing having a first housing member 212 and a second housing member 214 that may be moved relative to one another. Apparatus 200 also includes an ink pouch 216 and an ink transfer unit 218 that may be positioned relative to first and second housing members 212 and 214 such that when the first and second housing members 212 and 214 are moved relative to each other, ink flows from the ink pouch 16, through the ink transfer unit 218, and into an ink cartridge (not shown) positioned within second housing member 214.

There are several features of ink fill apparatus 200 (shown in FIG. 25) that assist in providing ink flow between the ink pouch 216 and an ink cartridge positioned within second housing member 214 when using the ink fill apparatus 200. Ink transfer unit 218 may include an alignment structure 220, a first biasing member 224, a piercing structure 226, and a plunger assembly 228. The plunger assembly is aligned off center relative to a vertical centerline 231 of the alignment structure 220 in order to be aligned with a print head of an ink cartridge that is positioned in the second housing member 214. The plunger assembly 228 may include a head portion 232, and a housing portion 234.

The bottom and cross-sectional views of FIGS. 26 and 27 and FIGS. 28 and 29 illustrate additional details of head portion 232 and housing portion 234, respectively. Head portion 232 includes a seal 280, a conduit 282 and a connecting protrusion 284. Seal 280 is adapted to form a seal around a print head of an ink cartridge that is being refilled. In different embodiments, seal 280 may be sized differently to account for creating a seal around different print head configurations. Conduit 282 facilitates ink flow through head portion 232. Protrusion 284 engages housing portion 234 to secure and align head portion 232 and housing portion 234 together (see FIG. 25).

Housing portion 234 includes a conduit 286, recessed area 288, and attachment clips 290 and 291. Conduit 286 is configured to receive piercing member 226 (see FIG. 25) and facilitate ink flow through housing portion 234. Recessed area 288 is configured to engage protrusion 284 of head portion 232 to secure plunger assembly 228 to alignment structure 220 (see FIG. 25).

Ink transfer unit 218 may also include a balancing member 229 (see FIGS. 25, 30 and 31) and a second biasing member 225 aligned opposite centerline 231 from plunger assembly 228 and positioned on the same side of alignment structure 220 as plunger assembly 228. Second biasing member 225 is adapted to engage an end of the ink cartridge being refilled adjacent a print head of the ink cartridge. The balancing member may include an alignment protrusion 296 and attachment clips 292–295. Alignment protrusion 296 aligns biasing member 225 with alignment structure 220 and a generally center portion of balancing member 229 (see FIGS. 25, 30 and 31). The attachment clips 292–295 secure balancing member 229 to alignment structure 220 while providing for some movement in the direction of centerline 231. Balancing member 229 is intended to facilitate balanced movement of alignment structure 220 relative to the ink cartridge being refilled as the first and second housing member 212 and 214 are moved relative to each other. Preferably, balancing member 229 and plunger assembly 228 undergo generally parallel movement in the direction of centerline 231 as first and second housing member 212 and 214 move relative to each other.

The ink refill apparatus 200 may also include a threaded sleeve 250 insertable into first housing member 212 and configured to engage threads formed in second housing member 214, and a gasket 219 that provides an interface between ink pouch 216 and alignment structure 220. In this embodiment, gasket 219 is also aligned off center from centerline 231 so that it aligns with plunger assembly 228 and piercing structure 226.

Ink transfer unit 218 may also include first and second adjustment clips 202 and 204 with flanges 208 and 209 that are configured to engage first and second track portions 264 and 266 of second housing member 214 to align ink transfer unit 218 within second housing member 214.

In a more broad view of the present invention, the invention may be practiced without housing members by simply aligning an ink transfer unit between an inlet port to an ink cartridge and a compressible ink pouch, and then applying pressure to the ink pouch to force the ink from the pouch into the cartridge. In this simplified configuration, the ink transfer unit may comprise only a sealing portion and a conduit portion that create fluid communication between the ink pouch and the ink cartridge. In another embodiment of the present invention, the ink transfer unit includes an aligning feature that engages the ink pouch and the ink cartridge to hold the pouch and cartridge in alignment while the ink pouch is compressed.

In another embodiment of the present invention, the ink transfer unit is mounted to a housing member that supports the ink cartridge to provide greater stability while the ink pouch is compressed. In a yet further embodiment, the housing member includes first and second members as described herein in relation to the Figures.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A refill apparatus for refilling a refillable container, the refill apparatus comprising:

a compressible pouch containing ink;

a compression device for holding the compressible pouch in alignment with the container to be refilled;

the compression device including first and second members that are moved relative to one another to compress the pouch such that ink flows from the pouch to the container.

2. The apparatus of claim 1 wherein the refillable container is an ink cartridge.

3. The apparatus of claim 1 wherein the compressible pouch comprises top and bottom ends, a deformable side wall, and a gasket controlling fluid communication with the pouch.

4. The apparatus of claim 1 further comprising a piercing structure that pierces the compressible pouch to create ink flow when the first and second members are moved relative to one another.

5. The apparatus of claim 1 wherein the first member defines a first receptacle having structure to receive the container to be filled, and the second member defines a second receptacle sized to receive the compressible pouch.

6. The apparatus of claim 5 wherein the first and second receptacles each include a threaded portion that engage the threaded portion of the other receptacle, and rotation of the receptacles relative to one another compresses the compressible pouch.

7. The apparatus of claim 1 further comprising an ink transfer unit that includes a plunger that forms a seal with an inlet to the container to be filled, and a piercing structure that pierces the compressible pouch to cause ink flow.

8. The apparatus of claim 7 further comprising a biasing member that biases the piercing structure away from the compressible pouch.

9. The apparatus of claim 7 further comprising an alignment structure that includes a first side facing the compressible pouch and a second side facing the container to be filled.

10. The apparatus of claim 9 wherein the compressible pouch includes a gasket that controls ink flow, and the first side of the alignment structure comprises an opening sized to receive the gasket.

11. The apparatus of claim 9 wherein the alignment structure further comprises adjustment clips for alignment of the ink transfer unit relative to the compressible pouch, the container to be filled, and the compression device.

12. The apparatus of claim 7 wherein the plunger further comprises a conduit extending from the seal to an outlet of the piercing structure to create fluid communication between the container to be filled and the compressible pouch.

13. The apparatus of claim 5 wherein the first and second receptacles are cylindrical shaped, and each receptacle includes an open end and a closed end.

14. The apparatus of claim 11 wherein the first receptacle includes a track portion that engages the adjustment clips to align the ink transfer unit.

15. The apparatus of claim 2 wherein ink from the pouch flows into the ink cartridge through a print head of the ink cartridge.

16. The apparatus of claim 2 wherein ink from the pouch flows into the ink cartridge through an opening in the ink cartridge that is separate from a print head of the ink cartridge.

17. A compressible ink pouch capable of holding ink and configured for use with an ink cartridge refill apparatus, the ink pouch comprising:

first and second ends and a side wall interposed between the first and second ends, the side wall configured to be collapsible; and a pierceable gasket member secured to the top or bottom end, the gasket providing access to ink within the ink pouch;

whereby compression of the ink pouch causes ink to exit the ink pouch through the gasket.

18. A method of refilling an ink cartridge, comprising the steps of:

inserting an ink refill container into an ink refill housing, the housing comprising a first member and a second member capable of moving relative to one other;

inserting an ink cartridge into the ink refill housing;

moving the first and second members relative to one other to compress the ink refill container such that ink flows from the ink refill container to the ink cartridge.

19. The method of claim 18 further comprising the step of piercing the ink refill container with a piercing structure to create ink flow between the ink refill container and the ink cartridge.

20. The method of claim 18 further comprising the step of positioning an ink transfer unit in the ink refill housing to align the ink refill container and the ink cartridge.

21. The method of claim 20 wherein the ink transfer unit comprises a plunger that forms a seal with a fluid inlet to the ink cartridge, and a piercing structure that pierces the ink refill container when the first and second members are moved relative to one another.

22. The method of claim 21 wherein the ink transfer unit further comprises a biasing member that biases the piercing structure away from the ink refill container.

23. The method of claim 21 wherein the ink transfer unit further comprises an alignment structure that includes a first side facing the ink refill container and a second side facing the container to be filled, wherein the first side comprises an opening for receiving a portion of the ink refill container.

24. The method of claim 23 wherein the alignment structure comprises adjustment clips for alignment of the ink-transfer unit relative to the ink refill container, the ink cartridge, and the ink refill housing.

25. The method of claim 18 wherein the ink refill container is a compressible ink pouch capable of holding ink.

26. An ink cartridge refill kit comprising:

a package;

a compressible ink pouch positioned within the package; and a compression structure positioned in the package, the compression structure providing contact with opposing outer surfaces of the ink pouch to compress ink out of the ink pouch.

27. The kit of claim 26 further comprising an ink transfer structure positioned within the package, the ink transfer structure comprising a piercing structure for piercing the ink pouch, and a sealing structure for forming a seal about a refill opening of an ink cartridge.

28. The kit of claim 26 further comprising a suction cleaning device positioned within the package.

29. The kit of claim 28 further comprising a cleaning fluid positioned within the package.

30. The kit of claim 29 further comprising a blowing cleaning device positioned within the package.

31. A compressible ink pouch capable of holding ink and configured for use with an ink cartridge refill apparatus, the ink pouch comprising:

first and second ends and a side wall interposed between the first and second ends, the side wall configured to be collapsible; and a pierceable gasket member secured to the top or bottom end, the gasket providing access to ink within the ink pouch;

whereby contacting the first and second ends of the ink pouch compresses ink out of the ink pouch through the gasket when the gasket is pierced.

32. The method of claim 18, further comprising removing the ink refill container after at least some ink flow has occurred, and replacing the ink refill container with a different ink refill container.

* * * * *